US005967368A

United States Patent [19]

Guillermier

[11] Patent Number: 5,967,368

[45] Date of Patent: Oct. 19, 1999

[54] DEVICE FOR CONNECTING A FLEXIBLE CONTAINER TO AN EXTERNAL DUCT, AND USES THEREOF

[76] Inventor: Bernard Guillermier, 42 rue de Provence, 74330 Epagny, France

[21] Appl. No.: 09/051,837

[22] PCT Filed: Oct. 17, 1996

[86] PCT No.: PCT/FR96/01625

§ 371 Date: Apr. 17, 1998

§ 102(e) Date: Apr. 17, 1998

[87] PCT Pub. No.: WO97/14374

PCT Pub. Date: Apr. 24, 1997

[30] Foreign Application Priority Data

Oct. 18, 1995 [FR] France ..... 95 12479

[51] Int. Cl.[6] ..... A61D 19/02

[52] U.S. Cl. ..... 222/81; 222/107; 141/114; 141/329; 604/905; 604/906; 600/35; 383/202

[58] Field of Search ..... 222/81, 107; 604/905, 604/906; 600/35; 141/329, 114; 383/200, 202

[56] References Cited

U.S. PATENT DOCUMENTS

| | | | |
|---|---|---|---|
| 3,236,697 | 2/1966 | Amiet et al. | 222/81 |
| 3,596,801 | 8/1971 | Barnack | 222/81 |
| 3,730,336 | 5/1973 | Feldman | 383/202 |
| 4,161,178 | 7/1979 | Genese | 141/329 |
| 4,161,949 | 7/1979 | Thanawalla | 141/329 |
| 4,355,737 | 10/1982 | Pongrass et al. | 222/81 |
| 4,403,603 | 9/1983 | Hutchins | 604/905 |
| 4,458,733 | 7/1984 | Lyons | 141/114 |
| 4,640,425 | 2/1987 | Cabernoch | 222/107 |
| 4,946,040 | 8/1990 | Ipenburg | 383/202 |
| 5,122,123 | 6/1992 | Vaillancourt | 604/905 |
| 5,350,372 | 9/1994 | Ikeda et al. | 141/329 |
| 5,884,758 | 3/1999 | Sigouin et al. | 383/200 |

FOREIGN PATENT DOCUMENTS

| | | |
|---|---|---|
| 0148473 | 7/1985 | European Pat. Off. . |
| 0605406 | 7/1994 | European Pat. Off. . |
| 2701249 | 8/1994 | France . |
| 1295834 | 11/1972 | United Kingdom . |
| 93/14986 | 8/1993 | WIPO . |

*Primary Examiner*—J. Casimer Jacyna
*Attorney, Agent, or Firm*—William H. Eilberg

[57] ABSTRACT

A connecting device for connecting a container (1) consisting of a sealed flexible bag (3) to an external duct (2) that includes a tube (4) with a connecting opening (5). A rigid tubular coupling (6) is loosely arranged within the flexible container (1) and comprises a frusto-conical projection (7) sized in such a way that it may be force-fitted into the opening (5). A user grasps the coupling (6) and places it against the inner surface of the bag (3) while placing the opening (5) of the external duct (2) against the outer surface of the bag (3), then axially presses on the coupling (6) so that it perforates the bag (3) and sealingly engages the opening (5). The fluid in the container (1) can then flow through the coupling (6) into the external duct (2).

10 Claims, 3 Drawing Sheets

DEVICE FOR CONNECTING A FLEXIBLE CONTAINER TO AN EXTERNAL DUCT, AND USES THEREOF

TECHNICAL FIELD OF THE INVENTION

The present invention concerns means for connecting a flexible container of fluid to an external duct, the container being formed of a sealed flexible bag delimiting at least one sealed compartment, and the external duct comprising a tube with an orifice for connection to the container.

Flexible containers are used in the most diverse applications to contain a fluid in a sealed flexible bag, usually made of plastic material. The container is usually connected to an external duct by providing a coupling, on the flexible bag of the container, fixed to the bag. When the container is designed to contain initially a fluid, the coupling is closed off by a stopper or a tear-off seal. The orifice of the external duct then fits over or into the coupling, and to allow the fluid to flow the seal is torn off or the stopper is removed. One drawback of a structure of the above kind is the relative complexity of the container, that has to include a rigid coupling associated with the flexible bag, and the relative complexity of use because of the need to remove the stopper or to tear off the seal to make the connection. Another drawback is that aseptic conditions are not assured, because there is a risk of pollution by bacteria when the external duct is connected to the container.

The same drawbacks exist in the device described in document GB-A-1 295 834, in which the container coupling closed off by a stopper is fitted afterwards: a conical coupling covered with a conical stopper is previously contained in the liquid in the flexible bag container; a perforated plate is applied to the outside face of the bag, and the coupling and the conical stopper are forced through the flexible bag and the perforation in the plate to grip the bag between a peripheral flange on the coupling and the perforated plate. The stopper is then removed, or the coupling is pierced, to fit an external duct. Aseptic conditions are not assured at the time of such fitting.

In document WO-A-93 14986, the coupling previously contained in the liquid in the flexible bag container has an ogival pointed and chamfered end, extended by a cylindrical body and a push-base. The end of a tubular external duct is applied to the outside face of the bag, and the chamfered coupling is forced to pierce the bag and enter the duct. The seal between the external duct and the container is not satisfactory.

Document EP-A-0 605 406 proposes flexible containers formed of a sealed flexible bag one side of which can be torn, for example by providing areas of weakness or pre-cut areas, the external duct having an end shaped to allow the user to introduce this end into the torn portion of the bag. Although the container can be made more economically than in the previous embodiment, handling is even more difficult because it is difficult to engage the end of the external duct in the opening of the flexible bag, the flexibility of the bag preventing accurate lining up, and it is even more difficult to prevent the fluid flowing out of the bag before the end of the external duct is inserted completely and correctly. Aseptic conditions are also not assured.

SUMMARY OF THE INVENTION

The problem addressed by the present invention is therefore that of designing a new structure for devices for connecting a flexible container to an external duct, preventing any outflow of the fluid during and after connection of the external duct to the flexible container.

Another object of the invention is to limit the risk of pollution of the fluid on passing between the flexible container and the external duct.

To achieve the above and other objects the invention provides a device for connecting a flexible container for fluid to an external duct, the container being formed of a flexible bag that can be welded to delimit at least one sealed compartment, the external duct comprising a tube with an axial passage with a connecting opening, a tubular rigid coupling being received freely inside the compartment delimited by the flexible bag and including an elongate axial projection having a free end sized to engage in the connecting opening of the tube of the external duct and its other end connected to a transverse push-base; the projection has a frustoconical outside surface, with a larger base adjacent the transverse push-base and a smaller base forming the free end of the projection, with a cone angle and a large diameter adapted to assure good wedging of the projection when it is introduced into the tube.

In an advantageous embodiment, the axial passage in the external duct tube portion adjacent the connecting orifice has a generally constant inside section.

The flexible bag is preferably at least partly transparent, so that the coupling can be seen from outside the bag to facilitate manipulation of the coupling.

BRIEF DESCRIPTION OF THE DRAWINGS

Other objects, features and advantages of the present invention will emerge from the following description of particular embodiments, given with reference to the accompanying drawings, in which.

DESCRIPTION OF THE PREFERRED EMBODIMENTS

Figure 1:
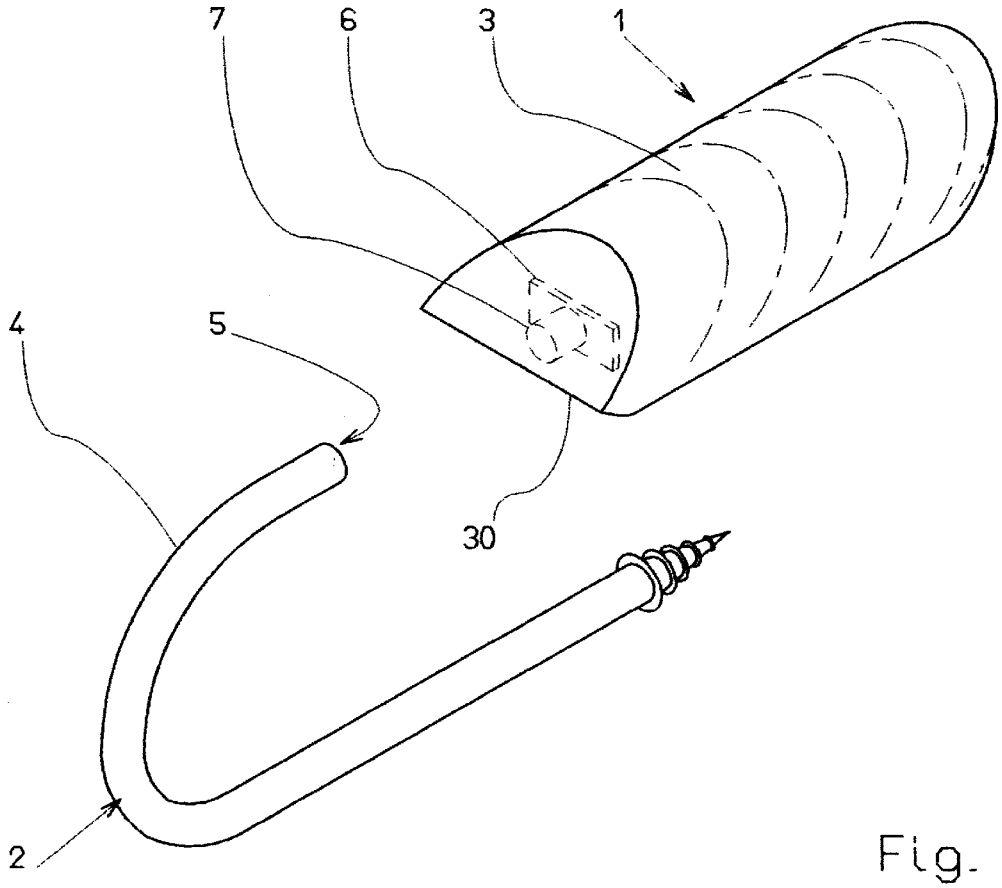
FIG. 1 is a perspective view of a system consisting of a flexible container and external duct, comprising a connecting device in accordance with the present invention.

As shown in FIG. 1, the connecting device of the invention is adapted to connect a flexible container 1 to an external duct 2. The container 1 is formed of a sealed flexible bag 3 that can be welded, delimiting at least one sealed compartment that can contain a fluid. In this example one end of the flexible container 1 is delimited by an edge 30 defining an internal re-entrant dihedron.

Figure 3:
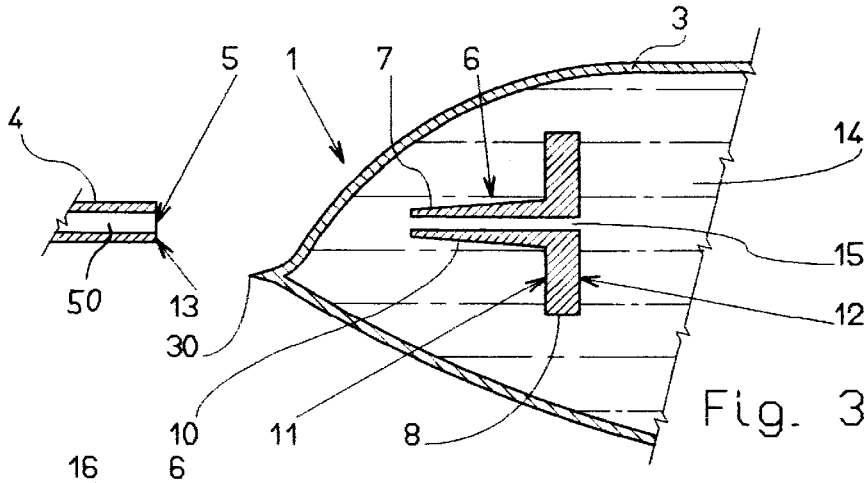
FIG. 3 is a side view in longitudinal section showing the end of the external duct, a portion of the flexible bag container containing a fluid, and the rigid coupling from FIG. 2.

The external duct 2 comprises a tube 4 with a connecting opening 5 at the end of an axial passage 50 that can be seen in FIG. 3 in particular.

In accordance with the invention, a tubular rigid coupling 6 is freely received inside the sealed compartment defined by the bag 3 of the container 1.

Figure 2:
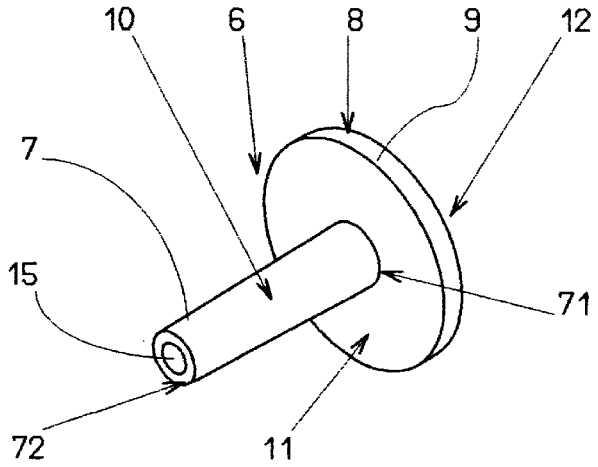
FIG. 2 is a perspective view of a tubular rigid coupling in one embodiment of the invention.

As seen more clearly in FIGS. 2 and 3, the tubular rigid coupling 6 has an elongate axial projection 7 with a free end 72 which is sized to fit into the connecting opening 5 of the tube 4 of the external duct 2, and its other end 71 is joined to a transverse opposite push-base 8. In the FIG. 2 embodiment, the transverse push-base 8 is a disk with an external contour 9 having a diameter greater than the diameter of the connecting opening 5. The tubular coupling 6 has an axial passage 15 through it.

As seen in FIG. 3 in particular, in one advantageous embodiment of the invention, the axial passage 50, at least in the tube portion 4 of the external duct adjacent the connecting opening 5, has a generally constant inside section, whereas the projection 7 of the coupling 6 has a generally frustoconical outside surface 10, so that it wedges progressively into the axial passage 50 inside the tube 4. The frustoconical outside surface 10 of the projection 7 is delimited by a smaller base forming the free end 72 of the projection 7, and by a larger base forming the other end 71 adjacent the transverse push-base 8.

Figure 8:
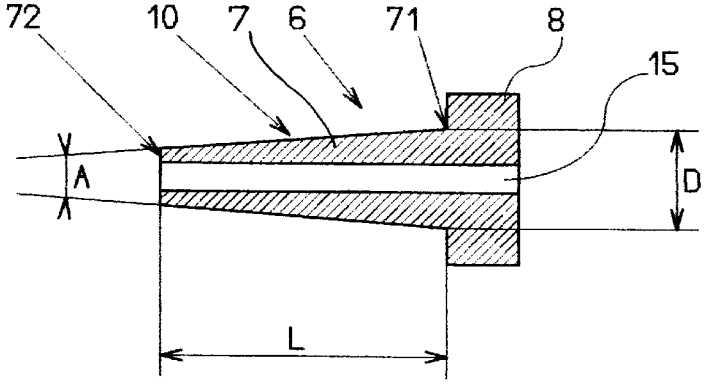
FIG. 8 is a side view in longitudinal section of the tubular rigid coupling from FIG. 7.

As seen better in FIG. 8, the outside surface 10 of the projection 7 has a cone angle A, that is preferably in the range approximately 2° to approximately 5°. The length L of the projection 7 is preferably at least equal to three times the diameter D of its larger base 71. The surface of the smaller base forming the free end 72 of the projection 7 is only slightly smaller than the cross-section of the axial passage 50 in the tube 4, and is free of any sharp edges and points.

In the embodiment shown in FIGS. 2 through 6, the disk forming the transverse push-base 8 has two radial anterior 11 and posterior 12 faces generally perpendicular to the axis of the coupling 6.

The opening 5 of the external duct tube 4 is bordered by a plane annular facet 13 generally perpendicular to the axis of the tube 4.

The container 1 can contain various fluids. For example, the container 1 can contain a liquid 14. In this case, it can be advantageous to make the coupling 6 from a material having a higher density than said liquid 14, to facilitate engaging the coupling 6 by gravity in the re-entrant dihedron of the edge 30.

The flexible bag 3 is preferably at least partly transparent, so that the coupling 6 can be seen from outside the bag 3 and to facilitate manipulation of said coupling 6.

Figure 7:
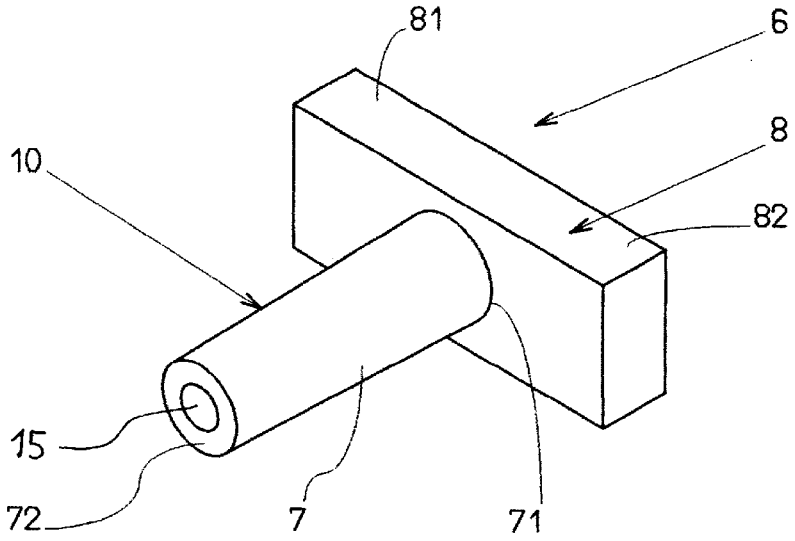
FIG. 7 is a perspective view of a tubular rigid coupling in a preferred embodiment of the invention.

In the embodiment shown in FIGS. 1, 7 and 8, the coupling 6 has a transverse push-base 8 in the form of a transverse beam extending radially to either side of the larger base 71 of the projection 7. The transverse beam thus comprises a first half-beam 81 projecting radially from one side of the projection 7, and a second half-beam 82 projecting radially from the opposite side of the projection 7. The length of the half-beams 81 and 82 can be chosen to define a comfortable surface on which to push. The half-beams 81 and 82 can be narrow in the widthwise direction, for example they can have a width slightly greater than or equal to the diameter of the larger base 71 of the projection 7, as shown in FIGS. 7 and 8. A transverse push-base 8 of this shape facilitates engagement in the re-entrant dihedron of the edge 30 as shown in FIG. 1, encouraging complete evacuation of the liquid contained in the container 1 on use.

To connect a container 1 to an external duct tube 4, the user carries out the sequence of steps shown in FIGS. 3 through 6.

Figure 4:
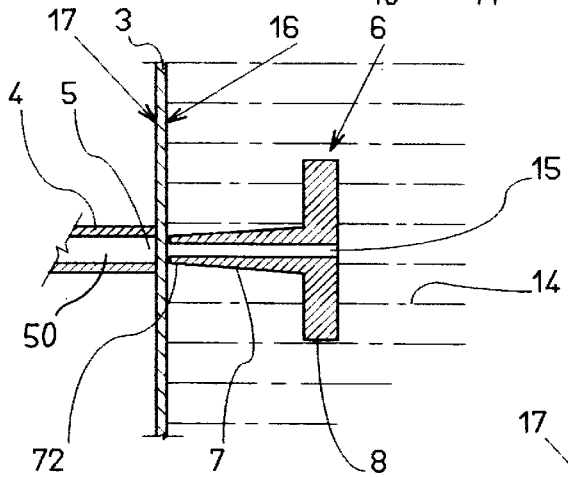
FIG. 4 is a side view in section showing the connecting device in one embodiment of the invention, in a preparatory position prior to connection.

Initially, the coupling 6 is free to move inside the bag 3 of the container 1. The user can see the coupling 6 through the transparent bag 3, or through the transparent part of the bag 3, and can manipulate the coupling 6 in the sealed compartment by deforming the flexible bag 3, so as to orient it and press the free end 72 of the projection 7 against the inside face 16 of an appropriate portion of the flexible bag 3 of the container 1, as shown in FIG. 4.

Figure 5:
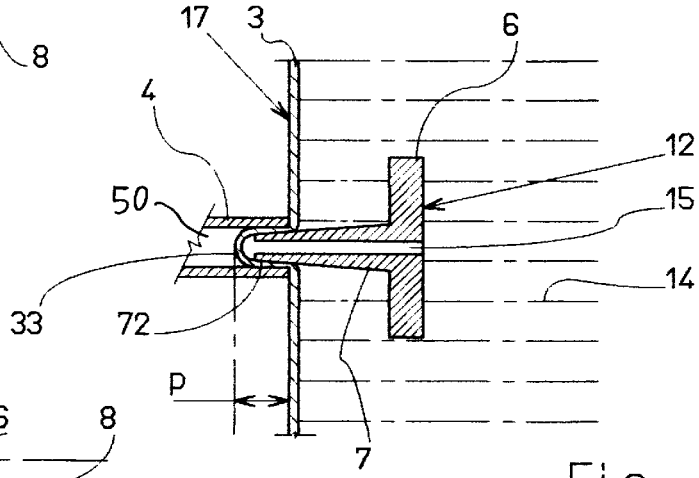
FIG. 5 is a side view in section of the connecting device from FIG. 4, in a partial penetration position before piercing.

The user simultaneously presses the orifice 5 of the tube 4 of the external duct 2 against the outside face 17 of said appropriate portion of the flexible bag 3, facing the free end 72 of the coupling 6. Holding the tube 4, the user can then press the coupling 6 axially outwards, bearing down on the posterior face 12 of the transverse push-base 8, so that its free end 72 begins to deform the flexible bag 3 as shown in FIG. 5, causing a portion 33 of the flexible bag 3 to penetrate into the axial passage 50 of the tube 4 to a penetration depth P. Because the projection 7 has a frustoconical shape, with a free end 72 having a non-negligible surface area and free of sharp edges or points, the portion 33 of the flexible bag 3 is stretched without tearing to a penetration depth P of several millimeters.

By applying increased axial pressure to the coupling 6, the user forces the free end 72 of the coupling 6 through the portion 33 of the bag 3, forming a passage between the penetrating edges 34. Because of the relatively great length of the penetrating edges 34, resulting from the great depth of penetration P before the portion 33 of the flexible bag 3 is pierced by the coupling 6, an effective seal is obtained.

Figure 6:
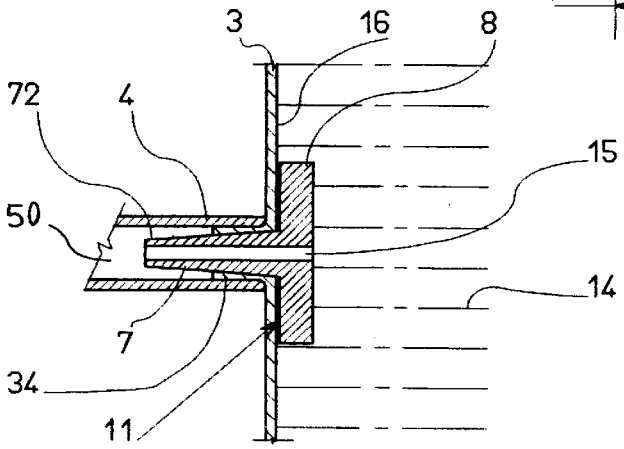
FIG. 6 is a side view in section of the device from FIG. 4 on completion of connection.

On completion of penetration, as shown in FIG. 6, the anterior face 11 of the push-base 8 of the coupling 6 can abut on the inside face 16 of the flexible bag 3, and the tubular part of the coupling 6 presses the penetrating edges 34 of the bag 3 radially against the inside face of the tube 4. The fluid 14 can flow from the container 1 to the tube 4 via the axial passage 15 of the coupling 6.

It is understood that, during penetration of the coupling 6, the external face portion 17 of the flexible bag 3 that enters the tube 4 is pressed against the inside face of the axial passage 50 of the tube 4. This prevents any pollution of the fluid 14 in the connection area, even if the outside face 17 of the flexible bag 3 is initially soiled. Choosing a length L of the projection 7 greater than the length of the penetrating edges 34 of the bag prevents contact between the fluid 14 and the extremity of the penetrating edges 34 of the bag, and this further reduces the risks of pollution.

To assure effective wedging of the projection 7 in the tube 4, guaranteeing a satisfactory seal and good mechanical strength, the diameter D of the larger base 71 is preferably chosen so that the sum of this diameter and twice the thickness of the flexible wall 3 forming the penetrating edges 34 is slightly greater than the inside diameter of the axial passage 50 of the tube 4.

One advantage of the invention is that the container can be particularly economic, formed of a flexible bag 3 with welded edges.

Plastic material bags 3 can be used, for example.

Figure 9:
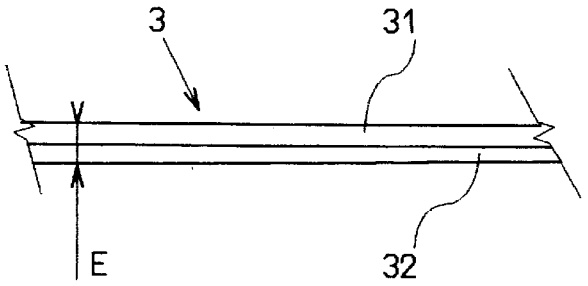
FIG. 9 shows in section a container flexible bag structure in one embodiment of the invention.

A significant improvement in the seal between the tube 4 and the container 1 is obtained by using a flexible bag 3 that can stretch considerably before rupturing, and which can be welded at low cost to constitute a sealed compartment containing the liquid. The above advantages are obtained by using a flexible bag 3 consisting of a two-layer film, for example, as shown in FIG. 9, with a polyamide outer layer 31 attached to a polyethylene inner layer 32. The polyethylene inner layer 32 can be welded. The polyamide outer layer 31 provides mechanical strength and authorizes considerable stretching. This increases the length of the bag portion constituting the penetrating edges 34, forming a more effective seal inside the tube 4. The two-layer film can advantageously have a thickness E in the range approximately 30 to 60 microns.

The connection is particularly appropriate for connecting a container 1 containing previously a fluid 14 that is to be transferred into the external duct 2.

Nevertheless the device of the invention applies equally to connecting a previously empty container 1 to be filled with a fluid fed through the external duct 2.

One particular application of the connecting device of the invention is in a device for animal insemination. The flexible container 1 then contains animal semen, and the external duct 2 is a probe for artificial insemination of animals such as sows.

The device could have many other uses such as, for example, blood transfusion, transportation of various liquids, or even transportation of various free-flowing powder or granular materials.

The present invention is not limited to the embodiments explicitly described, but includes variants and generalizations thereof contained within the scope of the following claims.

I claim:

1. A device for connecting a flexible container (1) for fluid (14) to an external duct (2), comprising a flexible container (1), a coupling (6) and a tube (4), the container (1) being formed of a flexible bag (3) that can be welded to delimit at least one sealed compartment, the external duct (2) comprising the tube (4) with an axial passage (50) with a connecting opening (5), the tubular rigid coupling (6) being housed freely inside the compartment delimited by the flexible bag (3) and including an elongate axial projection (7) a free end (72) of which is sized to engage in the connecting opening (5) of the tube (4) of the external duct (2) and the other end of which is connected to a transverse push-base (8), wherein the projection (7) has a frustoconical outside surface (10) with a larger base (71) adjacent the transverse push-base (8) and a smaller base forming the free end (72) of the projection (7), the flexible bag being adapted to stretch considerably before it ruptures, so that the smaller base of the free end (72) can deform the flexible bag (3) by causing a portion (33) of the flexible bag (3) to penetrate into the axial passage (50) of the tube (4) to a penetration depth (P) at the time of connection, the projection (7) having a cone angle (A) and a large diameter (D) adapted to assure good wedging of the projection (7) in the tube (4) when the portion (33) of the flexible bag (3) is engaged in the axial passage (50) of the tube (4).

2. Connecting device according to claim 1, wherein the projection (7) has a length (L) at least equal to three times the diameter (D) of its larger base (71).

3. Connecting device according to claim 1, wherein the axial passage (50) of the tube portion (4) of the external duct (2) adjacent the connecting opening (5) has a generally constant inside section.

4. Connecting device according to claim 1 wherein the cone angle (A) is in the range approximately 2° to 5°.

5. Connecting device according to claim 1 wherein the flexible bag (3) is at least partially transparent to enable the coupling (6) to be seen from outside the bag (3) and to facilitate manipulation of the coupling (6).

6. Connecting device according to claim 1 wherein the flexible bag (3) is made of a two-layer film, with a polyamide outer layer (31) attached to a polyethylene inner layer (32).

7. Connecting device according to claim 6, wherein the two-layer film has a thickness (E) in the range approximately 30 to 60 microns.

8. Connecting device according to claim 1 wherein the transverse push-base (8) is a transverse beam extending radially to either side of the larger base (71) of the projection (7).

9. Connecting device according to claim 1 wherein the container (1) contains a liquid (14), and the coupling (6) is made from a material the density of which is higher than that of said liquid (14).

10. An application of a connecting device according to claim 1 to a device for animal insemination, the flexible container (1) containing animal semen, the external duct (2) being a probe for artificial insemination of animals such as sows.

* * * * *